QUICK RELEASE SUBASSEMBLY FOR SHIFTING GRID CASE PACKER

This invention relates generally to case packers of the type having a shifting grid into which grid charges of articles are received in an upper portion of the grid for gravity feed into an upwardly open packing case, and deals more particularly with a shifting grid which includes a funnel subassembly for decelerating the articles as they drop downwardly through the grid, which subassembly can be easily removed for replacement or repair with a minimum down time to the packer.

A shifting grid case packer is generally used to pack articles of uniform size and shape, as for example bottles, cans or similar articles, in upwardly open cases or cartons which may include compartments or cells for holding the individual articles. A charge or slug of articles to be loaded is fed from an infeed conveyor across a deadplate into the upper portion of the grid, and a grid assembly is movably mounted on longitudinally extending ways such that the charge can be shifted downstream slightly while the line pressure of the oncoming articles on the infeed conveyor is interrupted by a line brake or similar holdback system. The grid assembly includes a shifting grid frame, which frame includes riding strips to support the articles in the upper portion of the grid in one position and to allow the articles to drop downwardly when the riding strips are shifted to a second position. A funnel subassembly is supported below the shifting grid and serves to guide the articles and to decelerate them slightly as they drop downwardly into the upwardly open packing case.

In setting up such a packer for handling articles of different size and shape, and/or handling charges of articles for filling different size cases, the packer must be shut down for a sufficient time to allow the grid assembly to be completely removed and replaced with an assembly of proper configuration to handle the different size articles and/or different size charge thereof.

The primary object of the present invention is to provide a unique subassembly for removal of only the funnel portion of such a shifting grid style packer when the requirement arises for setting up the packer to handle different size articles or the like.

Another object of the present invention is to provide a removable subassembly so designed that the riding strips which support the articles entering the upper portion of the grid can themselves be removed in a unique subassembly for replacement with a subassembly having a different spacing between the riding strips for handling articles of different diameters.

Both such subassemblies, that is for the funnel and for the riding strips, can be removed for replacement or repair without necessity for altering the generally rectangular grid frame, which is directly connected to the shifting cylinder for achieving the lateral shifting movement of the grid. The limited longitudinal movement of the grid, as required to achieve spacing between the articles stopped on the deadplate by the line brake and those to be dropped into the waiting packing case, is also achieved in the improved packer as disclosed herein.

The foregoing advantages are achieved in a shifting grid style packer of the type which is adapted to receive columns of articles from an infeed conveyor between side-by-side longitudinally extending lane guides so that the articles can be deposited in groups into upwardly open packing cases. The packer machine frame has longitudinally extending ways oriented parallel to the lane guides and a grid assembly is movably mounted on the ways. Cross slide means in the form of parallel longitudinally spaced shafts are oriented perpendicularly to the ways. A shifting grid frame is provided on the cross slide shafts and includes riding strips to support the articles when the grid frame is in one position, and to allow the articles to drop downwardly between these riding strips in a second position. A shifting cylinder moves the grid frame transversely between these two positions and funnel means is supported from the cross slide shafts, and has parallel rails with finger holders defining passageways for the articles moving downwardly into the case. These rails are provided vertically below the fixed lane guides, and it is an important feature of the present invention that the funnel means includes cross members adjacent the ends of the rails together with means for releasably securing these cross members to the cross slide shafts. One of said releasable means includes upwardly open sockets for receiving the downstream cross slide shaft, and the upstream cross member has end brackets defining bifurcated portions for receiving the upstream cross shaft in such a way that the entire funnel subassembly can be pivoted about this upstream cross shaft once the downstream cross shaft has been separated from the first mentioned cross member.

A further advantage of the funnel subassembly resides in the fact that each rail which supports the various holders in which the article engaging fingers are retained is itself uniquely assembled to the rail in such a way that no fasteners are required for each such holder, and instead a longitudinally extending rod is provided parallel to the rail for anchoring all the holders associated with a particular rail.

The following pending patent applications are incorporated by reference herein for purposes of supplementing the present disclosure. FINGER ASSEMBLY FOR A CASE LOADER, Ser. No. 182,103, Filed Aug. 28, 1980 by the applicant herein and assigned to the assignee herein relates specifically to the geometry for each of the holders for each of the fingers in the funnel subassembly to be described in detail herein. Ser. No. 269,389, filed June 1, 1981 by the applicant herein and assigned to the same assignee entitled SHIFTING GRID STYLE PACKER WITH LAND HOLDBACK illustrates the general configuration of a shifting grid style packer with which the invention disclosed herein might be conveniently adapted for use. The disclosure in said pending application is also incorporated by reference herein for purposes of delineating the general features of a shifting grid style packer.

FIG. 1A is a sectional view taken on the line 1A—1A of FIG. 1.

Figure 2:
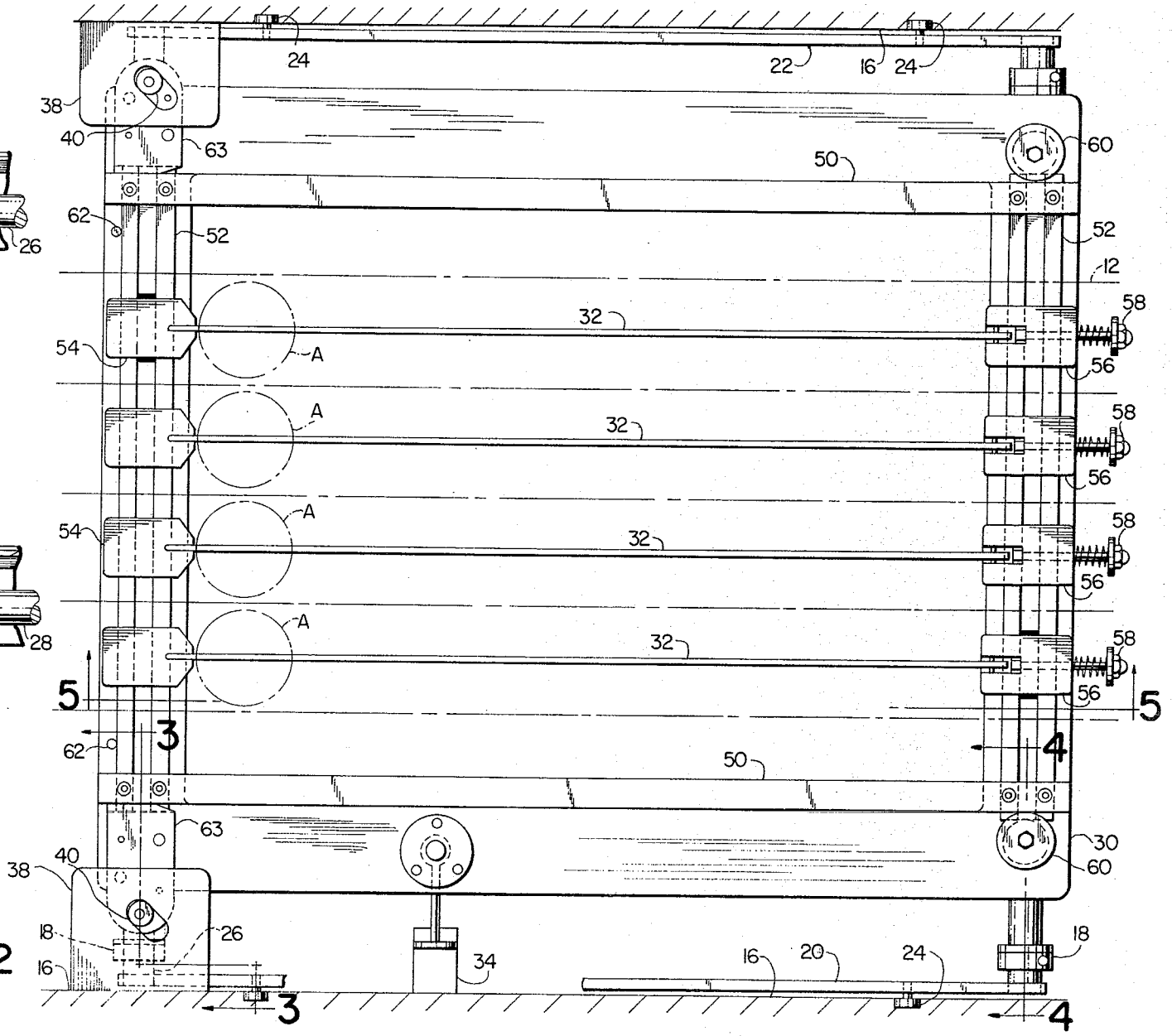
FIG. 2 is a plan view of the grid portion of the FIG. 1 packer with the fixed lane guides being illustrated in phantom lines, and with the frame of the packer being illustrated schematically to provide better detail on the grid frame and riding strip subassembly.
Figure 3:
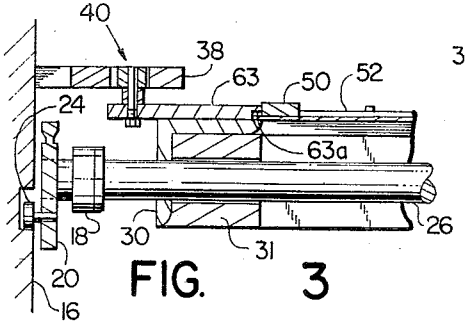
FIG. 3 is a vertical sectional view taken generally on the line 3—3 of FIG. 2.
Figure 4:
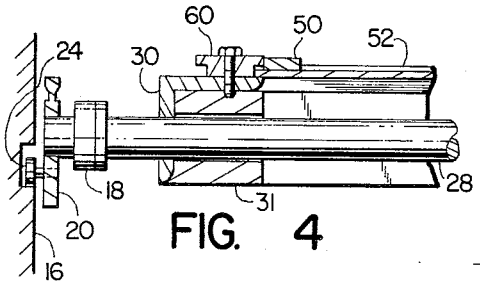
FIG. 4 is a vertical sectional view taken generally on the line 4—4 of FIG. 2.

locates the sliding subframe as the subframe is slid into place. Stop pins 62, 62 are provided in the upstream end of grid frame 30 and engage the subframe as shown in FIG. 2. At the upstream end of subframe 30 two plates 63, 63 which support the cam follower rollers 40 described above, also serve a second purpose in that each has an overhanging edge 63*a* for engaging the end portions of cross bar 52 and hence locating the subframe in the grid frame 30 in much the same way as do the rollers 60, 60 described above.

As so constructed and arranged, the riding strip subframe assembly can be readily removed for replacement or repair from a grid frame having a different riding strip configuration so as to accommodate either articles of different size, or charges of articles of different geometry than that shown.

Figure 1:
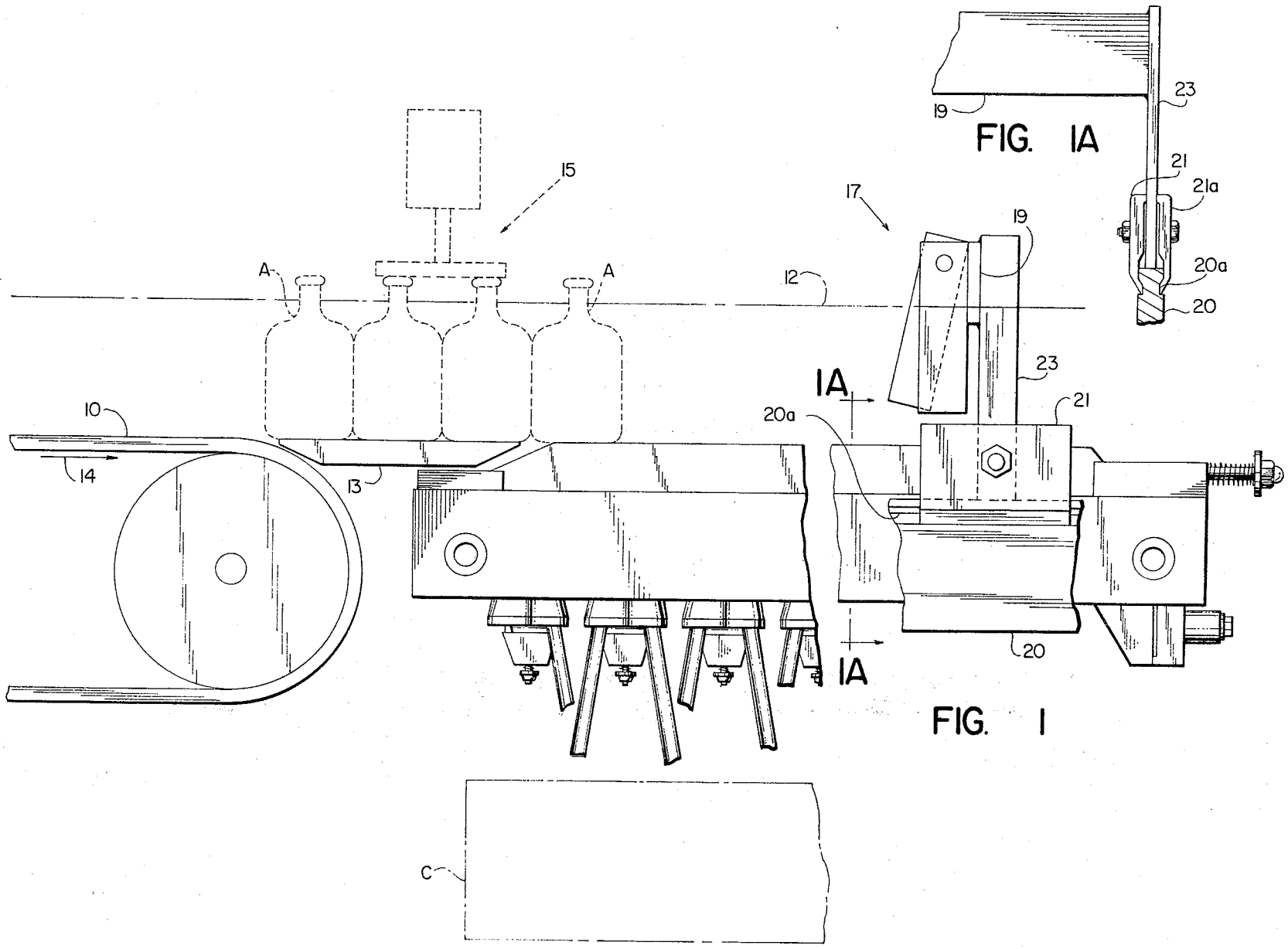
FIG. 1 is a side elevational view, with portions of a packer being illustrated in schematic fashion, to illustrate the environment for the present invention.
Figures 5, 6, 7, 8, 9:
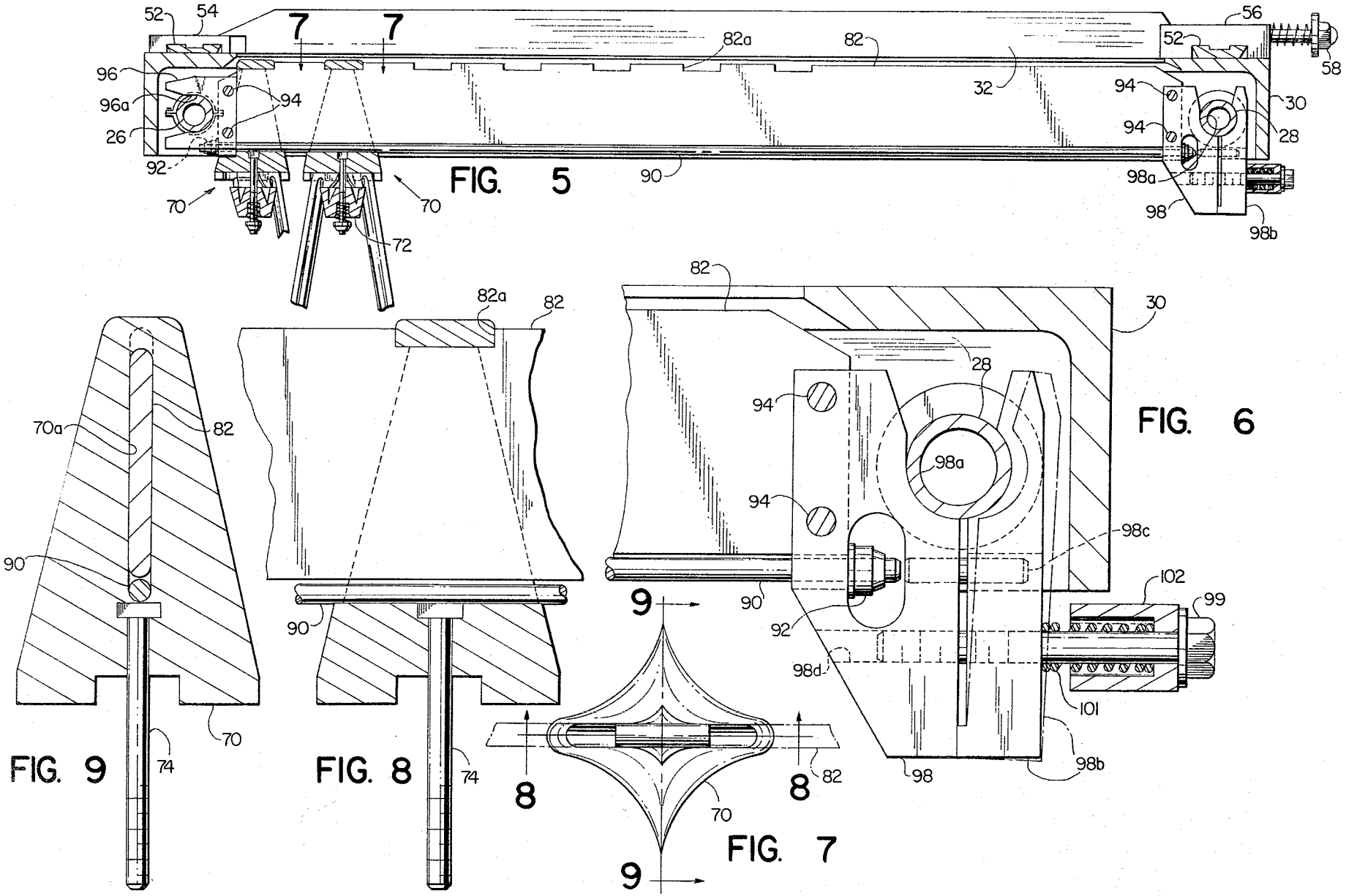

Turning next to a more complete description of the funnel subassembly the reader is referred to my copending application entitled FINGER ASSEMBLY FOR A CASE LOADER in order to gain a more complete understanding of the construction of and purpose for the various finger holder units such as indicated generally at 70, 70 in FIG. 5. These clusters of depending fingers serve to guide the descending articles as they drop downwardly through the open grid, and to an extent serve to decelerate these articles at they enter the upwardly open packing case C referred to previously with reference to FIG. 1. By way of reference, each of these finger holders is adapted to support up to four fingers in four adjacent corners of four associated pockets in a typical grid funnel assembly. Means is provided for mounting the finger holders in depending position on parallel rails such as shown at 52, 52 in FIG. 10 and one, two, three or four flexible fingers are adapted to extend downwardly and outwardly from sockets in the finger holder. Each finger is releasably retained in the assembly by opposed clamping of retaining surfaces in the holder and in a retaining member, such as shown at 72 in FIG. 5. Each finger is capable of limited pivotal movement at least toward and away from a normal center position associated with a particular pocket. A single fastener 74 extends upwardly through the retaining member and carries a coiled compression spring such that the restoring force on all fingers in a particular finger holder can be varied to cause its associated fingers to be urged toward their normal positions where each projects outwardly toward the center of an associated pocket. FIGS. 7, 8 and 9 shows the holder 70 with reference to an associated longitudinally extending rail 82. Each rail 82 preferably includes upwardly open notches 82*a* for receiving a portion of the holder 70 as described heretofore with reference to my prior copending application. The rail receiving opening 70*a* slidably receives the rail 82 as best shown in FIG. 9 because a removable rod 90 can be withdrawn to permit these holders to be so moved on rail 82. The ends of the rods 90, 90 are threaded to receive nuts 92, 92, which nuts serve to clamp each rod 90 to its associated rail 82 quite independently of the means (to be described) for supporting the funnel subassembly itself from the shafts 26 and 28. Thus, one can simply remove the nuts 92, 92 from the ends of the rod 90 and slide the rod out longitudinally when the funnel subassembly has itself been removed to a convenient place for reworking or the like.

Figure 10:
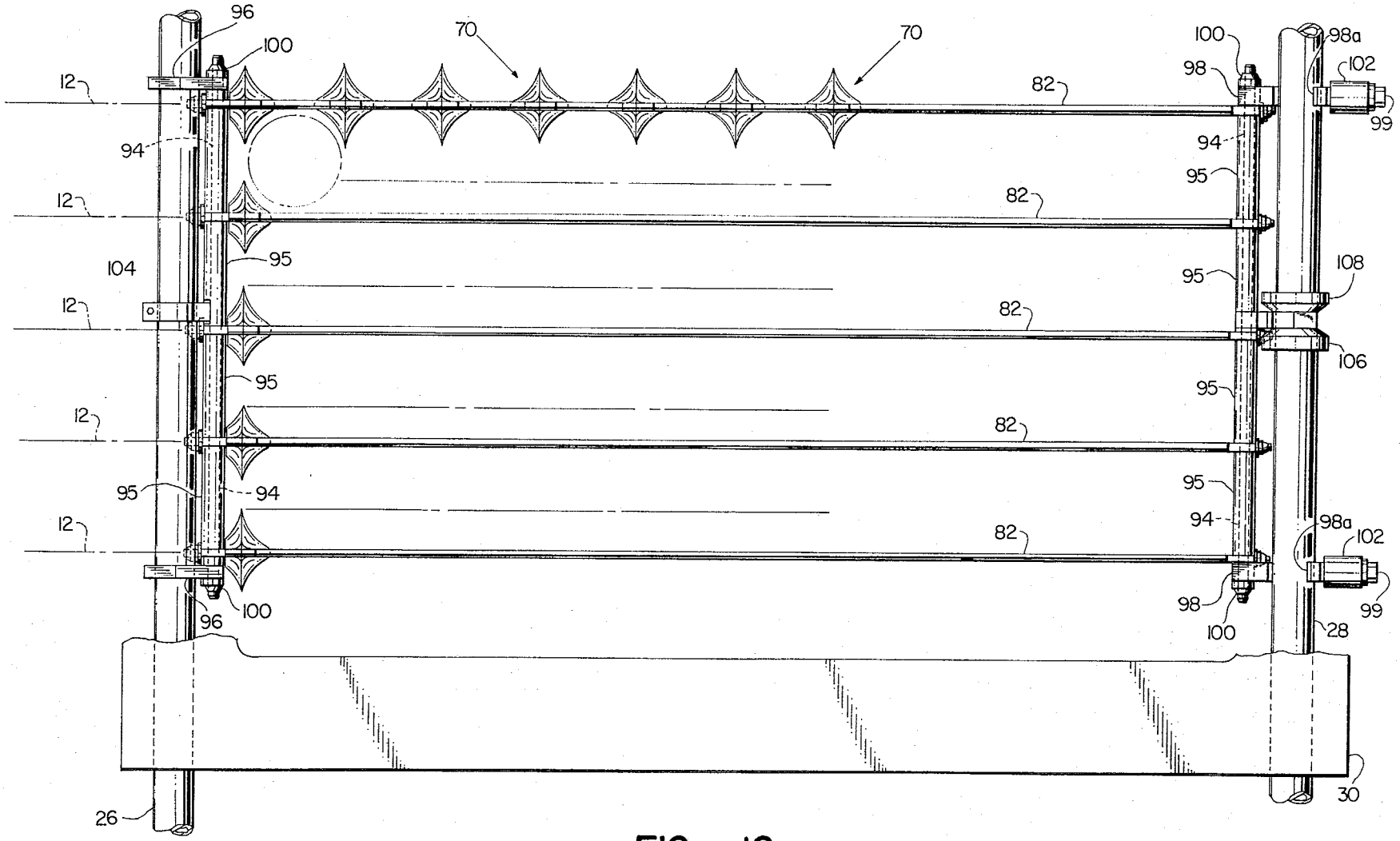

Turning next to a more complete description of the funnel subassembly itself and to the means for releasably supporting it from the cross shafts 26 and 28, FIG. 10 shows each of the several rails 82, 82 oriented in the same verical plane as that of an associated lane guide 12, 12. Cross members 94, 94 in the form of support rods (best shown in FIGS. 5 and 9) extend transversely through the end portions of these rods, and through brackets 96 and 98. These brackets 96 and 98 define sockets, 96*a* and 98*a* respectively, for receiving the cross shafts 26 and 28 respectively. Two support rods 94, 94 are received in each end of each rail 82, and spacers 95, 95 on these rods 94 serve to space the rails from one another in the funnel subassembly.

Still with reference to FIG. 10, the brackets 96, 96 at the upstream end of the funnel subassembly are supported on the ends of support rods 94, 94 by nuts 100, 100 threadably received on the threaded ends of these rods 94, 94. Each bracket 96 is of U-shape as best shown in FIG. 5 so that the funnel subassembly is pivotally supported on the hollow shaft 26 and hence capable of being pivoted downwardly and then removed from this shaft 26 after the opposite end has been disconnected from shaft 28 in the following manner.

The downstream brackets 98, 98 include two parts, a first part rigidly secured to the support rods 94, 94 and a second part 98*b* movably mounted on the first part as best shown in FIG. 6. These bracket parts cooperate to define the upwardly open sockets for releasably receiving shaft 28. As so constructed and arranged these sockets can be opened and closed manually to drop the downstream end of the funnel subassembly so that it pivots about the upstream shaft 26. Once the upper ends of brackets 98/98*a* clear the underside of the frame 30 the funnel subassembly can be removed for replacement or repair without necessity for disassembling or removing the grid frame 30. With the funnel subassembly on a workbench or the like one can quite easily disassemble the rods 94, 94 and also rods 90, 90 to repair or replace the finger holders on one or more of the rails 82, 82.

From FIG. 6 it will be apparent that each downstream bracket 98 has a movable part 98*b* slidably mounted to the first part 98 by a pin 98*c* and a threaded fastener 99 which is threaded in a threaded opening 98*d* and slidably receives the second part 98*b* as shown. A biasiang spring 101 acts against the head of fastener 99 (through collar 102) and against the second bracket part 98*b* to urge part 98*b* toward the solid line position (to close the socket opening 98*a* and hold funnel subassembly to rod 28. The collar 102 serves to anchor the two brackets together when fastener 99 is used to secure both brackets together in their solid line positions. By unthreading the screw 99 and grasping collar 102 one can then move the bracket downwardly as described above.

With reference to FIG. 10, a locating collar 104 on the upstream shaft 26 serves to guide the lateral location for the funnel subassembly with the grid frame. As the funnel subassembly is lifted into position, by pivoting on the shaft 26, its downstream end is located by two spaced locating collars 106 and 108.

I claim:

1. In a shifting grid style packer of the type wherein columns of articles are received from an infeed conveyor between side-by-side longitudinally extending lane guides for the deposit of groups of articles downwardly into upwardly open packing cases, the improvement comprising a fixed frame having longitudinally extending ways oriented parallel to the lane guides, a grid assembly movably mounted on said ways and itself defining cross slide means oriented transversely to said ways, a shifting grid frame on said cross slide means and including riding strips to support the articles when said grid frame is in one position and to allow the articles to drop downwardly in a second position, means for shifting said grid frame transversely between said two positions, funnel means supported by said cross slide means and defining passageways for the articles moving downwardly into the case, said funnel means including parallel rails provided vertically below said fixed lane guides, said funnel means further including cross members adjacent the ends of said rails, and means for releasably securing said cross members to said cross slide means to facilitate removal of said funnel means without necessity for removal of said grid frame.

2. The combination defined by claim 1 further characterized by pocket defining fingers mounted to said rails to define individual pockets for each of the articles in a group as the articles are so dropped into the packing case.

3. The combination defined by claim 1 wherein said cross slide means comprises longitudinally spaced shafts which are restricted to move only in said longitudinal direction, and said means for releasably securing said cross members to said spaced shafts including transversely spaced brackets mounted to each of said cross members, said brackets on one cross member defining sockets for pivotally receiving one of said shafts, and said brackets on the other cross member having upwardly open sockets for receiving the other of said shaft.

4. The combination defined by claim 3 wherein each of said brackets with said upwardly open sockets is more particularly defined by a first part secured to said cross member and a second part movably mounted to said first part so that said upwardly open socket can be opened and closed manually from below said grid frame to facilitate removal of said funnel means.

5. The combination defined by claim 4 wherein said second part of each bracket is slidably mounted to the corresponding first part, and spring biasing means for urging said second part toward said first part to close said upwardly open socket.

6. The combination defined by claim 1 wherein said riding strips are parallel to one another and to said rails, said grid frame in said one position orienting said strips in the vertical planes of said rails, and in said second position said grid frame orienting said riding strips between said planes of said rails, said grid frame having a generally open rectangular planform with said riding strips extending parallel to the sides of said grid frame, said grid frame further including a rectangular subframe supported in said open rectangular grid frame, end blocks securing said riding strips to said subframe, and said subframe being removably received on said grid frame to facilitate removal of said subframe and riding strips without necessity for removal of said grid frame.

7. The combination defined by claim 6 wherein said subframe is slidably received in said open rectangular grid frame for movement longitudinally thereof whereby said subframe and riding strips can be removed for replacement or repair from the downstream end of the grid assembly.

8. The combination defined by claim 7 wherein said cross slide means comprises longitudinally spaced shafts which are restricted to move only in said longitudinal direction, and said means for releasably securing said cross members to said spaced shafts including transversely spaced brackets mounted to each of said cross members, said brackets on one cross member defining sockets for pivotally receiving one of said shafts, and said brackets on the other cross member having upwardly open sockets for receiving the other of said shaft.

9. The combination defined by claim 8 wherein each of said brackets with said upwardly open sockets is more particularly defined by a first part secured to said cross member and a second part movably mounted to said first part so that said upwardly open socket can be opened and closed manually from below said grid frame to facilitate removal of said funnel means.

10. The combination defined by claim 9 wherein said second part of each bracket is slidably mounted to the corresponding first part, and spring biasing means for urging said second part toward said first part to close said upwardly open socket, said closable sockets located at the downstream end of said grid assembly to permit downward movement of the downstream end of said funnel means during removal.

11. The combination defined by claim 1 further characterized by finger holders on each of said rails, said holders having openings for slidably receiving said rails, each rail having upwardly open notches for locating said holders, and an elongated member for shimming said holders and securing said holders in said notches.

12. The combination defined by claim 11 wherein said elongated members are generally coextensive in length with said rails, and wherein the ends of said members are threaded to receive nuts which abut the ends of said rails.

13. The combination defined by claim 3 wherein said cross members comprise rods with threaded ends, said brackets having openings so as to be removably received on said rods, and nuts to secure said brackets on said threaded rod ends.

14. The combination defined by claim 13 further characterized by spacers on said cross member rods to achieve a desired lateral spacing between said funnel subassembly rails.

15. The combination defined by claim 14 further characterized by finger holders on each of said rails, said holders having openings for slidably receiving said rails, each rail having upwardly open notches for locating said holders, and an elongated member for shimming said holders and securing said holders in said notches.

16. The combination defined by claim 15 wherein said elongated members are generally coextensive in length with said rails, and wherein the ends of said members are threaded to receive nuts which abut the ends of said rails.

17. In a shifting grid style packer of the type wherein columns of articles are received from an infeed conveyor between side-by-side longitudinally extending lane guides for the deposit of groups of articles downwardly into upwardly open packing cases, the improvement comprising a grid frame including riding strips to support the articles when said grid frame is in one position and to allow the articles to drop downwardly when in a second position, means for shifting said grid frame transversely between said two positions, cross slide means to support said grid frame for said shifting movement, funnel means supported by said cross slide means and defining passageways for the articles moving downwardly into the case, said funnel means including parallel rails provided vertically below said fixed lane guides, said funnel means further including cross members adjacent the ends of said rails, and means for releasably securing said cross members to said cross slide means to facilitate removal of said funnel means without necessity for removal of said grid frame.

18. The combination defined by claim 17 wherein said riding strips are parallel to one another and to said rails, said grid frame in said one position orienting said strips in the vertical planes of said rails, and in said second position said grid frame orienting said riding strips between said planes of said rails, said grid frame having a generally open rectangular planform with said riding strips extending parallel the sides of said grid frame, said grid frame further including a rectangular subframe supported in said open rectangular grid frame, end blocks securing said riding strips to said subframe, and said subframe being removably received on said grid frame to facilitate removal of said subframe and riding strips without necessity for removal of said grid frame.

19. The combination defined by claim 17 further characterized by lane detectors for each lane of said shifting grid frame, and means for supporting said lane detectors from a common cross beam so that they can be adjustably positioned longitudinally of said shifting grid frame.

20. The combination defined by claim 18 further characterized by lane detectors for each lane of said shifting grid frame, and means for supporting said lane detectors from a common cross beam so that they can be adjustably positioned longitudinally of said shifting grid frame.

* * * * *

United States Patent [19]

Brooks

[11] 4,406,112

[45] Sep. 27, 1983

[54] PRESSURE AIR MANIFOLD AND OUTLETS SYSTEM FOR GRAIN HEADER OR HARVESTER CUTTING PLATFORMS

[76] Inventor: Donald G. Brooks, 92 Northstead St., Scarborough, Western Australia, Australia, 6019

[21] Appl. No.: 325,887

[22] Filed: Nov. 30, 1981

[30] Foreign Application Priority Data

Mar. 3, 1981 [AU] Australia ..... PE7820

[51] Int. Cl.[3] ..... A01D 57/22

[52] U.S. Cl. ..... 56/12.9; 56/13.3; 56/DIG. 8

[58] Field of Search ..... 56/12.8–13.4, 56/DIG. 8, 11.9

[56] References Cited

U.S. PATENT DOCUMENTS

| | | | |
|---|---|---|---|
| 1,900,269 | 3/1933 | Altgelt et al. | 56/12.9 |
| 2,502,810 | 4/1950 | Waters | 56/DIG. 8 |
| 3,165,874 | 1/1965 | Osteen | 56/DIG. 8 |
| 3,193,995 | 7/1965 | Miller | 56/12.9 |

FOREIGN PATENT DOCUMENTS

| | | | |
|---|---|---|---|
| 624215 | 8/1961 | Italy | 56/11.9 |

*Primary Examiner*—Jay N. Eskovitz

*Attorney, Agent, or Firm*—Townsend and Townsend

[57] ABSTRACT

An improved pressure air manifold and outlets system for grain header or harvester cutting platforms comprising a manifold which extends across and above the cutting platform, the manifold being adjustable for height position and angularity and being provided with a plurality of relatively narrow shaped outlet tubes which depend from the manifold and which terminate nominally above the cutter bar of the cutting platform, each outlet tube being directed to discharge pressure air substantially in a rearward direction also some air in a lateral direction to form a continuous curtain of air and a blower to impart an air flow through the manifold to discharge through the outlet tubes.

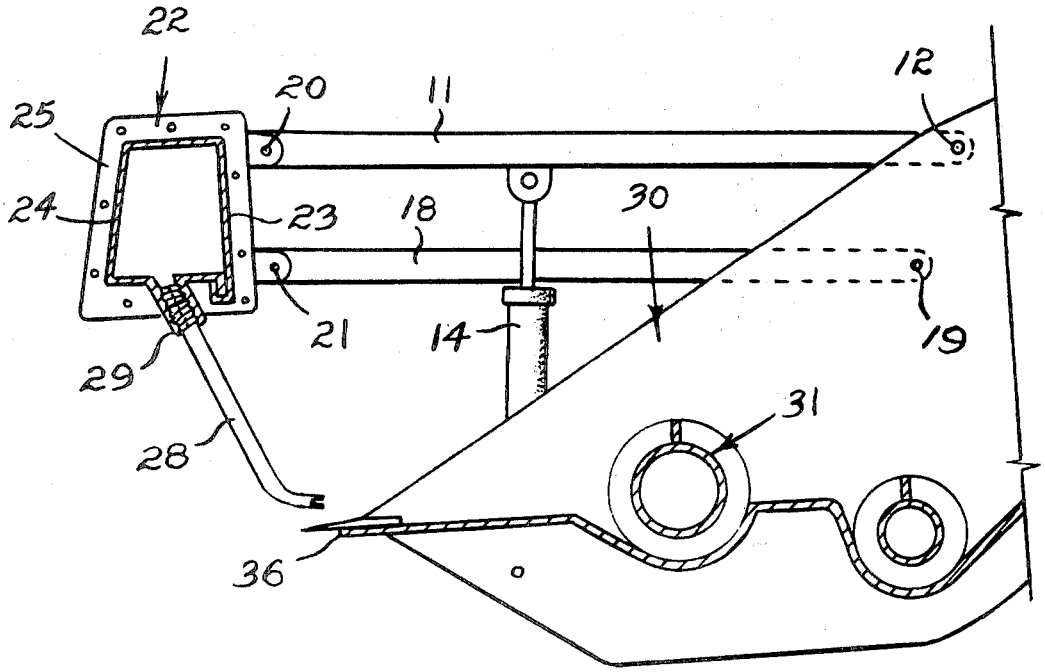

10 Claims, 5 Drawing Figures